US008278259B2

(12) United States Patent
Shamayeli et al.

(10) Patent No.: US 8,278,259 B2
(45) Date of Patent: Oct. 2, 2012

(54) LIQUID MEMBRANE-COMPATIBLE DETERGENT COMPOSITION

(75) Inventors: Khalil Shamayeli, Düsseldorf (DE); Thomas Merz, Hilden (DE); Ralf-Erbo Knop, Hilden (DE)

(73) Assignee: Ecolab USA Inc., St. Paul, MN (US)

( * ) Notice: Subject to any disclaimer, the term of this patent is extended or adjusted under 35 U.S.C. 154(b) by 609 days.

(21) Appl. No.: 12/281,885

(22) PCT Filed: Mar. 6, 2006

(86) PCT No.: PCT/EP2006/060465

§ 371 (c)(1), (2), (4) Date: Apr. 13, 2009

(87) PCT Pub. No.: WO2007/101470

PCT Pub. Date: Sep. 13, 2007

(65) Prior Publication Data

US 2009/0320214 A1 Dec. 31, 2009

(51) Int. Cl.
*C11D 17/00* (2006.01)

(52) U.S. Cl. ..... 510/407; 510/421; 510/426; 510/428; 510/506

(58) Field of Classification Search ..... None
See application file for complete search history.

(56) References Cited

U.S. PATENT DOCUMENTS

| | | | | |
|---|---|---|---|---|
| 4,556,504 | A * | 12/1985 | Rek | 510/418 |
| 4,597,889 | A | 7/1986 | Jones et al. | |
| 6,402,891 | B1 | 6/2002 | Asher et al. | |
| 2004/0091427 | A1 | 5/2004 | Moodycliffe et al. | |

FOREIGN PATENT DOCUMENTS

| | | |
|---|---|---|
| EP | 0469847 | 2/1992 |

* cited by examiner

*Primary Examiner* — Necholus Ogden, Jr.
(74) *Attorney, Agent, or Firm* — Merchant & Gould P.C.

(57) ABSTRACT

The invention relates to a liquid detergent concentrate composition comprising an emulsion having a water phase and an oil phase, the composition comprising 5-30 wt-% of one or more alkalinity source
1-70 wt-% of at least one nonionic surfactant
0.01-10 wt-% of at least one crosslinked or partly crosslinked polyacrylic acid or polymethacrylic acid.

Furthermore the invention relates to a stable aqueous use solution, comprising a liquid detergent concentrate according to the invention and to a method for washing textiles with the aqueous use solution.

18 Claims, No Drawings

LIQUID MEMBRANE-COMPATIBLE DETERGENT COMPOSITION

FIELD OF THE INVENTION

The invention relates to a liquid detergent composition concentrate, to a stable aqueous use solution comprising the liquid detergent concentrate composition, and to a method for washing textiles. The liquid detergent composition can be provided as a concentrate or as a use solution. The liquid detergent composition in the form of the concentrate or the use solution is an emulsion of the type water-in-oil emulsion or oil-in-water emulsion dependent on the amounts of water and oil in the emulsion.

BACKGROUND OF THE INVENTION

In institutional and industrial washing processes the wastewater of the washing process is usually cleaned and purified by using membrane filtration units. The obtained purified water can then be re-used in another washing cycle. The use of a membrane filtration process for the cleaning of wastewater results in a decrease of the amount of fresh water required to be added to the washing cycle and accordingly in a reduction of costs and saving resources. Also from an environmental standpoint the use of membrane filtration is meaningful.

However, the membrane cleaning processes can only be applied for wastewater which does not contain components blocking the membrane of the membrane filtration unit. Therefore it is necessary to use membrane-compatible detergents in these washing processes which do not contain any membrane-blocking or membrane-destroying components.

In the state of the art membrane-compatible detergent compositions are already known. However, most of these detergents are detergents in paste form having a high viscosity.

WO 2005/118760 A1 describes for example a membrane-compatible pasty soap composition which is used in a washing process in which the wastewater is purified by a membrane filtration unit and especially in a membrane filtration unit comprising one or more reverse osmosis steps. The detergent comprises anionic surfactants, non-ionic surfactants, an alkalinity source, and an organic and/or inorganic builder on a non-silicate basis. Furthermore the composition is free of greying inhibitors on a cellulose basis, silicates, and phosphates.

As non-ionic surfactants fatty alcohol alkoxylates are used which are ethoxylated and/or propoxylated. Furthermore the composition comprises alkyl polyglycoside having 8 to 14 carbon atoms.

The paste has a high viscosity which is preferably between 30,000 to 60,000 mPas at 50 revolutions per minute measured using a Brookfield rotational viscosimeter with spindle no. 7 at 25° C.

A further paste-like detergent is described in WO 02/46351 A1. This detergent is also used in a washing process in which the accumulated wastewater is cleaned by a filtration process using a membrane filtration unit.

The use of detergents in paste form in washing processes has the disadvantage that expensive dosing units are necessary to pump the high viscous paste into the institutional and industrial washing machines. Therefore there is a need for providing a liquid membrane-compatible detergent concentrate having low viscosity which can be pumped through the washing device by using standard pumping units which are less expensive.

In principle liquid detergents are known from the state of the art. Such detergents are for example described in U.S. Pat. No. 5,880,083, WO 2004/065535 A1, and WO 2004/041990 A1. However, the liquid detergents which are used in the state of the art often contain components which cause the blocking of the membrane filtration unit and hence cannot be used for washing processes in which membrane filtration units are used for the cleaning of the wastewater. Those components if used in high amounts are for instance cationic surfactants, certain emulgators, carboxymethylcellulose and silicates. These components immediately block the membrane and lead to an interruption of the whole washing process. By leaving such components out of the detergent composition the stability of the liquid detergent composition which is normally an emulsion or dispersion is decreased. This decreased stability results in a separation of the emulsion or the dispersion after storage or when used at extremely different temperatures. Separated emulsions or dispersions cannot be used in the washing process and cannot be dosed using the usual dosing units.

Therefore it is necessary to treat the separate phases in order to obtain the homogenous emulsion or the dispersion again. With some liquid detergents this is even not possible so that the separated emulsions or dispersions cannot be used any longer and have to be disposed.

SUMMARY OF THE INVENTION

Hence the technical object of the invention is to provide a low viscous liquid membrane-compatible detergent as an emulsion comprising only components which do not affect the filtration process in the membrane filtration unit for the wastewater of the washing process and which nevertheless are stable emulsions which do not separate in several phases after being stored or when used at highly different temperature ranges.

The technical object of the invention is solved by a liquid detergent concentrate composition comprising an emulsion having a water phase and oil phase, the composition comprising 5 to 30 wt. % of one or more alkalinity sources, 1 to 70 wt. % of at least one non-ionic surfactant, 0.01 to 10 wt. % of one or more crosslinked or partly crosslinked polyacrylic acids or polymethacrylic acids or mixtures thereof.

DETAILED DESCRIPTION OF THE INVENTION

The liquid detergent concentrate composition according to the invention only contains components which do not affect the filtration process in the membrane filtration unit and do not block the membrane. Furthermore the liquid detergent concentrate composition according to the invention is a stable emulsion which does not separate when being stored. The emulsion is also stable at lower temperatures, for example −5° C. If the emulsion is frozen at temperatures below −10° C. and melted thereafter, the emulsion is formed again without stirring the composition. This is particularly important when the emulsion is stored outside for example in the wintertime where outside temperatures are lower than −5° C. Even under these extreme conditions the liquid detergent concentrate composition according to the invention is a stable emulsion, does not separate and recovers completely at ambient temperatures.

Usually the detergent composition is made available as a concentrate and/or shipped or stored as a concentrate in order to avoid the expense associated with shipping and/or storing a composition containing a large amount of water.

The concentrate is then normally diluted at the location of use to provide a use solution. Furthermore it is also possible that the concentrate is first diluted to provide a more dilute concentrate and then a ready-to-use composition is prepared by further diluting the diluted concentrate.

The liquid detergent composition comprises one or more alkalinity sources in an amount of 5 to 30 wt. % preferably 10 to 20 wt. %. The alkalinity source can be an alkali hydroxide preferably sodium hydroxide and/or potassium hydroxide. Metal silicates, like sodium metasilicate cannot be used as alkalinity source as such silicates are not membrane-compatible and block the membrane.

Moreover it has to be noted that the grade of alkalinity in the present liquid detergent concentrate composition is quite high and much higher than in usual household detergent concentrate compositions in which minor amounts of silicates, alkalimetalhydroxides, sodium carbonates or sodium hydrogen carbonates are used as alkalinity sources.

The liquid detergent concentrate composition according to the invention comprises 1 to 70 wt. %, preferably 3 to 60 wt. %, and most preferably 5 to 45 wt. % of a non-ionic surfactant. The non-ionic surfactant usually is a compound which is selected from the group consisting of alcohol alkoxylates, alkyl phenol alkoxylates, alkyl thio alkoxylates, ethoxylate-propoxylate oligomers, alkoxylated esters, alkoxylated carboxylic acids, alkoxylated salts of carboxylic acids, ethers, amines, amine oxides, amides, and mixtures thereof.

In a preferred embodiment as a non-ionic surfactant one or more alkoxylated alcohols are used having the formula $R—(OC_2H_4)_x—(OC_3H_6)_y$, wherein R is a C6-C22 alkyl or alkenyl group, x is 0 to 18 and p is 0 to 10 and the sum of x and y is at least 5 and one of x or y may be 0. Other suitable non-ionic surfactants are liquid alkoxylated preferably ethoxylated and/or propoxylated alcohols.

Most preferred are primary alcohols preferably containing 8 to 18 carbon atoms and an average of 1 to 12 moles of ethylene oxides or propylene oxides per mole of alcohol in which the alcohol already may be linear or 2-methylbranched or may contain linear and methyl-branched radicals in the form of the mixtures typically present in oxoalcohol radicals. Particularly preferred non-ionic surfactants of these types are alcohol ethoxylates containing linear radicals of alcohols with 8 to 18 carbon atoms, for example coconut fatty alcohol, tallow fatty alcohol or oleyl alcohol which may contain an average of 2 to 8 EO units per molecule. Preferred ethoxylated and/or propoxylated alcohols include for example $C_{13}$-$C_{15}$ alcohols containing 6 EO units, $C_{12}$-$C_{14}$ alcohols containing 5 EO (ethylene oxide) units and 4 PO (propylene oxide) units, $C_{10}$ isoalcohols containing 3 EO units, $C_{13}$-$C_{15}$ alcohols containing 7 EO units, $C_{13}$-$C_{15}$ alcohols containing 3 EO units and/or 10 EO units or mixtures of these non-ionic surfactants.

Such non-ionic surfactants are available under the trade names Lutensol from BASF, Dehyphon by Cognis, or Plurafac by BASF.

The non-ionic surfactants are used to provide the resulting use solution with desired detersive properties. The non-ionic surfactant components can include a mixture of non-ionic surfactants.

A further component of the liquid detergent concentrate composition is 0.01 to 10 wt. %, preferably 0.05 to 8 wt. %, most preferred 0.1 to 5 wt. % of one or more crosslinked or partly crosslinked polyacrylic acids and/or polymethacrylic acids. This substance is used as thickener and stabiliser for a liquid detergent concentrate composition which is an emulsion. In a preferred embodiment polyacrylic acid or polymethacrylic acid is crosslinked or partly crosslinked with a polyalkenyl polyether compound as crosslinker. Those compounds are available under the trade name Carbopol® from Noveon.

The liquid detergent concentrate composition according to the invention has a viscosity in the range of from 500 to 10,000 mPas, preferably 600 to 6,000 mPas, and most preferred from 700 to 5,000 mPas at 20° C. measured at 20 revolutions per minute on a Brookfield RVT viscosimeter with spindle no. 2. This low viscosity allows it to pump the liquid detergent concentrate by using standard pumping devices and it is not necessary to use specific pumping devices for high-viscous liquids. Because of the low viscosity of the product can be dosed by usual standard peristaltic pumps which are much cheaper than pumps for higher viscous fluids.

As mentioned above the liquid detergent concentrate composition according to the invention is a membrane-compatible composition. That means that it does not contain any components destroying or blocking the membrane which is used for the cleaning of the wastewater in the washing process. Therefore the liquid detergent concentrate composition according to the invention does not contain any cationic surfactant. Exemplary cationic surfactants which are not contained in the liquid detergent concentrate composition according to the invention include quaternary ammonium compounds, amine salts, and mixtures thereof.

There are other compounds which are normally used in liquid detergents also having a negative effect on the membrane filtration unit if they are present in higher amounts.

In a preferred embodiment the liquid detergent concentrate composition according to the invention contains alkyl polyglycoside as emulsifying agent in an amount less than 1 wt. %. Preferably no alkyl polyglycoside is present. Alkyl polyglycoside is used as an emulsifier in detergent compositions. However, alkyl polyglycosides tends to foam building in the detergent composition and thus lower the washing performance of the detergent. Furthermore the building of foam has a negative influence on the membrane filtration unit as a liquid with foam on it is difficult to filter in the membrane filtration unit.

The same applies to a further component normally used in other liquid detergents, namely fatty acid soaps. Fatty acid soaps are often used as inorganic surfactants in liquid detergents. However, similar to alkyl polyglycoside, fatty acid soaps tend to accelerate the building of foam especially in soft water. Therefore, in a preferred embodiment the amount of fatty acid soap in the concentrate composition according to the invention is lower than 1 wt. %, preferably no fatty acid soap is present in the liquid detergent concentrate composition according to the invention. Besides sodium or potassium soaps form lime soaps in the presence of hard water. Lime soaps are water insoluble and block membranes.

In a further preferred embodiment the amount of EDTA in the liquid detergent concentrate composition is less than 10 wt. %, most preferred no EDTA is present in the liquid detergent concentrate composition.

The liquid detergent composition according to the invention has a high stability when stored at room temperature over a longer period of time. The emulsion is even stable under very cold conditions below 0° C. where the emulsion does not separate.

In a preferred embodiment the droplet size of the emulsion is less than 25 μm, preferably less than 10 μm.

In a further preferred embodiment the content of water in the liquid detergent concentrate composition is between 5 and 40 wt. %, preferably 10 to 25 wt. %.

As the liquid detergent concentrate composition is preferably used as a detergent for institutional and industrial washing the detergent does not contain any bleaching agents. In institutional and industrial washing processes the bleaching agent is normally dosed separately from the detergent. Only in powder household detergents bleaching agents are present.

The liquid detergent concentrate composition according to the invention is as a concentrate as well as a use solution highly alkaline because it contains high amounts of an alkalinity sources. The pH range of the use solution is 11 to 14, preferably 12 to 14. The pH range of the concentrate is 13-14, preferably pH 14. This pH value is by far higher compared to the normal household washing detergents.

The emulsions according to the invention show a viscoelastic behaviour. The emulsion is stable about one year at room temperature and about four months at 40° C. The emulsion achieves a very high performance level compared to similar liquid detergent concentrates which are not compatible with membrane filtration processes. Furthermore the product fulfils important environmental requirements especially in the European countries because it does not contain in a preferred embodiment EDTA as complexing agent.

The product according to the invention is characterised by a high amount of non-ionic surfactant, a high alkalinity, and a high stability at temperatures lower 0° C. preventing the product from separating at lower temperatures. The product is staying stable for a long time and does not separate into different phases nor shows precipitations.

Furthermore the liquid detergent concentrate composition preferably does not contain carboxymethylcellulose, which is used as greying inhibitor in usual detergents. This compound blocks the membrane of the membrane filtration unit.

The liquid detergent concentrate according to the invention can furthermore contain usual additives selected from the group consisting of builders, pH modifiers, antimicrobial agents, abrasives, anti-redeposition agents, sequestrants, softener, conditioner, viscosity modifying agents, wetting modifying agents, enzymes, optical brightener and mixtures thereof.

Builders and sequestrants that can be used as components include organic builders, inorganic builders, and mixtures thereof. Exemplary organic builders include organic compounds such as the salts or the acid form of nitriloacetic acid and its derivatives, amino carboxylates, organic phosphonates, amides, polycarboxylates, salicylates and their derivatives, derivatives of polyamino compounds or mixtures thereof. Examples of nitriloacetic acid derivatives include sodium nitriloacetate and magnesium nitriloacetate. Exemplary aminocarboxylates include sodium iminosuccinates. Exemplary organic phosphonates include amino tri(methylenephosphonate), hydroxyethylidene diphosphonate, diethylenetriamine penta(methylenephosphonate), ethylenediamine tetra(methylenephosphonate), and 2-phosphonobutane-1,2,4-tricarboxylate (Bayhibit AM by Bayer). Exemplary polycarboxylates include citric acid and its salt and derivatives, sodium glutarate, potassium succinate, and polyacrylic acid and its salts and derivatives and copolymers. Exemplary polyamino compounds include diethyltriaminepentaacetic acid (DPTA), hydroxyethylene diamine, and salts and derivatives thereof. Exemplary organic builders include at least one of a builder selected from polyacrylates or their copolymers, iminodisuccinate, citrate, ethylenediamine or triamine derivatives, and mixtures thereof. Exemplary inorganic builders include sodium tripolyphosphate, sodium carbonate, sodium pyrophosphate, potassium pyrophosphate. When the detergent composition includes builders and sequestrants the builders and sequestrants can be provided in an amount of between 5 wt. % and 30 wt. %, preferably between 10 wt. % and 20 wt. %, based on the weight of the detergent composition.

Exemplary antimicrobials that can be used as the suspended particulate component include alkyl parabens such as methyl paraben and propyl paraben; phenolic derivatives such as t-amylphenol; metals and their oxides and salts such as silver, silver iodide, zinc oxide; halogenated hydantoin derivatives such as bromochlorodimethylhydantoin, dichlorodimethylhydantoin, dibromodimethylhydantoin; hypohalites such as calcium hypochlorite, sodium hypobromite; and oligomers or polymers such as povidone iodine or povidone peroxide.

When the detergent composition includes antimicrobials as the suspended particulate component, the antimicrobials can be provided in an amount of between about 0.001 wt. % and about 3 wt. % and between about 0.5 wt. % and about 2 wt. %, based on the weight of the detergent composition.

Exemplary pH modifiers that can be used as the suspended particulate component include inorganic acidic compounds like sodium hydrogen sulfate, calcium hydrogen phosphate, organic acid compounds like carboxylic acids such as oxalic acid, polyacrylic acid, inorganic alkaline compounds like hydroxides, carbonates, and organic When the detergent composition includes pH modifiers as the suspended particulate component, the pH modifiers can be provided in an amount of between about 1 wt. % and about 30 wt. % and between about 5 wt. % and about 15 wt. %, based on the weight of the detergent composition.

Exemplary abrasives suitable for use as the suspended particulate component include calcium carbonate, talc, sodium, pieces of polymeric material such as shredded polyethylene or polypropylene, and pumice. When the detergent composition includes abrasives as the suspended particulate component, the abrasives can be provided in an amount of between about 0.5 wt. % and about 10 wt. % and between about 1 wt. % and about 5 wt. %, based on the weight of the detergent composition.

Exemplary anti-redeposition agents that can be used as the suspended particulate component include polyacrylates and their copolymers. When the detergent composition includes anti-redeposition agents as the suspended particulate component, the anti-redeposition agents can be provided in an amount of between about 0.1 wt. % and about 10 wt. % and between about 1 wt. % and about 5 wt. %, based on the weight of the detergent composition.

Exemplary softeners or conditioners that can be used as the suspended particulate component include both fabric and skin softeners. Exemplary softeners include fatty alcohols, fatty esters, fatty alcohols, glycerine, vitamins, and amino acids. When the detergent composition includes softeners or conditioners as the suspended particulate component, the softeners or conditioners can be provided in an amount of between about 1 wt. % and about 30 wt. % and between about 5 wt. % and about 20 wt. %, based on the weight of the detergent composition.

Exemplary viscosity modifiers that can be used as the suspended particulate component include alkanolamides, alkanolamines, inorganic bases and acids, When the detergent composition includes viscosity modifiers as the suspended particulate component, the viscosity modifiers can be provided in an amount of between about 0.1 wt. % and about 5 wt. % and between about 0.5 wt. % and about 2 wt. %, based on the weight of the detergent composition.

Exemplary wetting modification agents that can be used as the suspended particulate component include: EO-PO derivatives and silane derivatives.

When the detergent composition includes wetting modification agents as the suspended particulate component, the wetting modification agents can be provided in an amount of between about 0.1 wt. % and about 5 wt. % and between 0.5 wt. % and about 3 wt. %, based on the weight of the detergent composition.

Exemplary enzymes that can be used as the suspended particulate component include proteases, lipases, amylases, cellulases, oxydases, peroxydases, esterases, and mixtures thereof. The liquid detergent concentrate can include an enzyme in an amount of between about 0.1 wt. % and about 10 wt. %, and between about 1 wt. % and about 5 wt. %.

The liquid detergent concentrate composition according to the invention optionally contains an anionic surfactant in an amount of 0 to 15 wt. %, preferably of from 0.5 to 8 wt. % which may be selected from the compounds comprising C8-C18 alkyl sulfates, C8-C18 alkyl ether sulfates, C8-C18 alkyl sulfonates, C8-C18 α-olefine sulfonates, sulfonated C8-C18 fatty acids, C8-C18 alkyl benzene sulfonates, sulfosuccinate mono and di C1-C12 alkyl esters, C8-C18 alkyl polyglycol ether carboxylates, C8-C18 n-acyl taurides, C8-C18 n-sarcosinates, C8-C18 alkyl isothionates, and mixtures thereof.

The liquid detergent concentrate includes a sufficient amount of water which is in the liquid detergent concentrate composition between 5 and 40 wt. %, preferably 10 to 25 wt. % related to the whole detergent concentrate.

In general a stable emulsion is characterised by a lack of phase separation when the emulsion is allowed to stand at room temperature for at least seven days. Emulsions with a better performance will not phase separate when allowed to stand at room temperature for at least fourteen days and preferably at least 30 days.

The present liquid detergent concentrate according to the invention has an even higher stability which is one year at 20° C. and four months at 40° C.

The liquid detergent concentrate can be diluted with water to provide the use solution. The step of diluting can take place by pumping into a water stream, aspirating into a water stream, pouring into water or by combining water with the concentrate. In a preferred embodiment the use solution comprises the liquid detergent concentrate according to the invention in a concentration of 0.5 to 25 wt-%, preferably 1 to 10 wt-% based on the detergent use solution.

The liquid detergent concentrate composition is preferably an emulsion. This liquid detergent concentrate composition according to the invention is prepared by mixing the solid and the fluid components of the detergent composition when the solid phase is dispersed in the liquid phase as homogeneous as possible. By thoroughly mixing the components and grinding the resulting mixture an emulsion is prepared having a homogeneous distribution of the water and oil phase in the emulsion. During this process the solid parts of the composition are solved in the solvent.

The liquid detergent concentrate composition according to the invention is used for washing textiles. The method for washing textiles comprises providing the liquid detergent, diluting the liquid detergent to a stable aqueous use solution in a concentration of 0.5 to 25 wt. %, preferably 1 to 10 wt-% based on the whole use solution and washing the textiles in an institutional or household washing machine in the detergent use solution. In a preferred embodiment the wastewater of the washing process is accumulated during the washing process and purified using membrane filtration unit.

The liquid detergent concentrate composition according to the invention has the advantage that the concentrate allows purification of wastewater which is accumulated during the cleaning or washing process using common membrane filtration units without blocking them or causing other damage to the membrane. The membrane filtration may as well comprise at least one ultrafiltration and/or reverse osmosis step. Said purification processes succeed best with the concentrate according to the invention.

In addition the liquid detergent concentrate composition according to the invention is a highly stable emulsion which does not separate when stored for one year at 20° C. Furthermore the emulsion is even stable at lower temperatures below 0° C. or under freeze and thaw conditions.

The inventive composition and the method according to the invention will be further described in the following examples which are meant to exemplify the present invention without restricting its scope. In the following all amounts mentioned refer to wt. % based on the whole liquid detergent concentrate composition unless otherwise indicated.

EXAMPLES

Example 1

Example 1 describes in table 1 specific examples of the liquid detergent concentrate compositions according to the invention. All examples F1 to F9 are emulsions which are stable over a period of one year at 20° C. or four months at 40° C.

Comparative example 1 describes a liquid detergent composition not containing any crosslinked polyacrylic acid. Instead of the crosslinked polyacrylic acid the comparative example comprises alkyl polyglycoside as an emulsifier.

TABLE 1

| (wt-%) | | | | | |
|---|---|---|---|---|---|
| | F1 | F2 | F3 | F4 | F5 |
| Hydroxyethylidene diphosphonate Acid | 2 | 2 | 2 | 2 | 2 |
| Optical brightener DMS/X (1) | 0.4 | 0.4 | 0.4 | 0.4 | 0.4 |
| Distyryl biphenyl derivate (2) | 0.1 | 0.1 | 0.1 | 0.1 | 0.1 |
| Sodium citrate 2 hydrate | 12 | | 12 | | |
| Sodium tripolyphosphate | | 12 | | | |
| Methyl glycine diacetic acid sodium salt | | | | 7.5 | 7.5 |
| Iminodisuccinate sodium salt | | | | 14.8 | 14.8 |
| Nitrilotriacetic acid | | | 5 | | |
| Potassium hydroxide. solution 50% | 23 | 23 | 5 | 25 | 35 |
| Sodium hydroxide. solution 50% | 12.5 | 12.5 | 23 | 15 | |
| Fatty alcohol alkoxylate | | 6 | 10 | | |
| Fatty alcohol•oxoalcohol C13-15 + 6 EO (3) | | 4 | | 4 | |
| Fatty alcohol•C12-14 + 5EO + 4 PO (4) | 6.5 | | | 8 | 9.5 |
| Oxoalcohol•C10 iso + 3EO (5) | | | 5 | | 5.0 |
| Fatty alcohol•C13-15 + 7EO (6) | | | | | |
| Fatty alcohol•C13-15 + 3EO/10EO (7) | 4 | | | | 5.0 |
| alkylbenzene sulfonic acid | 0.5 | 0.5 | 0.5 | 5 | 0.5 |
| Polycarboxylate maleic/acrylic acid copolymer | 5 | 5 | 10 | 6 | 7.5 |
| crosslinked polyacrylic acid polymer (8) | 0.5 | 0.5 | 0.2 | | 0.7 |
| crosslinked polyacrylic acid. suspension (9) | | | | 1.5 | |
| Silicon emulsion | 0.1 | 0.1 | 0.1 | 0.1 | 0.2 |
| Perfume oil | 0.5 | 0.2 | 0.5 | 0.5 | 0.6 |

TABLE 1-continued

| (wt-%) | | | | | |
|---|---|---|---|---|---|
| | F6 | F7 | F8 | F9 | Comp. Ex. 1 |
| Hydroxyethylidene diphosphonate Acid | 2 | 2.5 | 2.5 | 2.5 | 2.5 |
| Optical brightener DMS/X (1) | 0.4 | 0.3 | 0.3 | 0.3 | 0.3 |
| Distyryl biphenyl derivate (2) | 0.1 | 0.1 | 0.1 | 0.1 | 0.1 |
| Sodium citrate 2 hydrate | | | | | |
| Sodium tripolyphosphate | | | | 15.0 | 15.0 |
| Methyl glycine diacetic acid sodium salt | 7.5 | 7.5 | | | |
| Iminodisuccinate sodium salt | 14.8 | 14.8 | | | |
| Nitrilotriacetic acid | | | 20.0 | 10.0 | 10.0 |
| Potassium hydroxide. solution 50% | 35.0 | | 25.0 | 25.0 | 25.0 |
| Sodium hydroxide. solution 50% | | 25.0 | | | |
| Fatty alcohol alkoxylate | | | | | |
| Fatty alcohol•oxoalcohol C13-15 + 6 EO (3) | | | | | |
| Fatty alcohol•C12-14 + 5EO + 4 PO (4) | 9.5 | 19.5 | 25.0 | 15.0 | 15.0 |
| Oxoalcohol•C10 iso + 3EO (5) | | | | | |
| Fatty alcohol•C13-15 + 7EO (6) | 10.0 | | | | |
| Fatty alcohol•C13-15 + 3EO/10EO (7) | | | | | |
| alkylbenzene sulfonic acid | 0.5 | 1.0 | 1.0 | 1.0 | 1.0 |
| Poly-carboxylate•maleic/acrylic acid copolymer | 7.5 | 7.5 | 5.0 | 7.5 | 7.5 |
| crosslinked polyacrylic acid polymer (8) | 0.7 | 1.6 | 0.5 | 2.0 | |
| crosslinked polyacrylic acid. suspension (9) | | | | | |
| Silicon emulsion | 0.2 | | | | |
| Parfume oil | 0.6 | 0.3 | 0.3 | 0.3 | 0.3 |
| Alkyl polyglycoside | | | | | 2.0 |

(1) Tinopal DMX/X (Ciba)
(2) Tinopal CBS/X (Ciba)
(3) Lutensol TO 6 (BASF)
(4) Dehypon LS54 (Cognis)
(5) Lutensol ON 30 (BASF)
(6) Lutensol AO 7 (BASF)
(7) Lutensol 31090 (BASF)
(8) Carbopol EDT 2691 (Noveon)
(9) Carbopol Aqua 30 (Noveon)
The rest up to 100 wt-% is deionized water

Example 2

In example 2 the liquid detergent concentrate according to F9 in table 1 was compared with the comparative example 1 in table 1. The two compositions were tested with respect to their washing performance using a common washing cycle at 60° C. with pre-wash and artificial soil strips as commercially available like those by WFK. For testing the primary performance 2 g/l of the concentrate of comparative example 1 was used at 60° C. The primary performance was tested with soft water (0° dH (deutsche Härte)) and with hard water (160 dH (Deutsche Härte)). The results are shown in table 2.

TABLE 2

| Primary Performance | | |
|---|---|---|
| | Procedure | |
| | Hard water (16° dH), 60° C., 2 g/l detergent concentrate | Soft water (0° dH), 60° C., 2 g/l detergent concentrate |
| Composition | Washable soil * (% remission value) | Washable soil * (% remission value) |
| F9 (Tab. 1) | 52 | 55 |
| Comp. Ex 1 (Tab. 1) | 49 | 55 |

* representing soilings of grease, oil, pigment

The values shown in table 2 indicate that the composition F9 according to the invention has a similar washing performance in soft water as the comparative composition but a better washing performance in hard water.

Example 3

The secondary performance of the composition F9 and the comparative example 1 from table 1 was tested. Test textiles were washed in hard water at 70° C. with 2 g/l detergent concentrate. Twenty-five wash cycles were carried out. After that the whiteness degree, the lost of tensile strength of the textile, and the ash were measured.

TABLE 3

| Secondary Performance | | | |
|---|---|---|---|
| | Procedure Hard water (16° dH), 70° C., 2 g/l detergent concentrate 25 wash cycles | | |
| Composition | Whiteness degree | Loss tensile strength of textile (MPa) | Ash % |
| F9 (Tab. 1) | 184 | 8 | 0.8 |
| Comp. Ex 1 (Tab. 1) | 184 | 13 | 1.3 |

From table 3 it can be seen that the whiteness degrees of the composition according to the invention and the comparative example 1 is identical. However, there is a difference in loss of tensile strength of the textile. The loss of tensile strength in the textile is much lower for the concentrates according to the invention compared to the comparative composition. This finding is also confirmed by the content of ash which is much lower in the composition according to the invention compared to the comparative composition.

Example 4

In example 4 the storage stability of the composition F9 was compared to the composition according to comparative example 1. The liquid detergent concentrate compositions which are emulsions were stored for several weeks at different temperatures. The results of the test are shown in the following table 4.

TABLE 4

| Storage Stability of Concentrate emulsion | | | |
|---|---|---|---|
| | Composition | | |
| | after 20 weeks at 5° C. | after 20 weeks at 20° C. | after 20 weeks at 40° C. |
| F9 (Tab. 1) | liquid, no dephasing | liquid, no dephasing | liquid, no dephasing |
| Comp. Ex 1 (Tab. 1) | dephasing (after 10 weeks) | dephasing (after 10 weeks) | dephasing (after 6 weeks) |

It can be seen that the composition F9 does not show any dephasing even after twenty weeks at 40° C. In contrast the comparative example 1 shows a dephasing at 5° C. after ten weeks and at 40° C. the composition according to the comparative example 1 is only stable for six weeks. After six weeks the composition dephases. Therefore comparative example 1 is less storage-stable.

The invention claimed is:

1. A stable emulsion concentrate composition comprising a water phase and an oil phase, the composition comprising based on the whole concentrate 5-30 wt-% of one or more alkalinity source;

1-70 wt-% of at least one nonionic surfactant selected from the group consisting of:

alcohol alkoxylates, alkyl phenol alkoxylates, alkyl thio alkoxylates, ethoxylate-propoxylate oligomers, alkoxylated esters, alkoxylated carboxylic acids, alkoxylated salts of carboxylic acids, ethers, amines, amine oxides, amides, and mixtures thereof; and 0.01-10 wt-% of at least one crosslinked or partly crosslinked polyacrylic acid or polymethacrylic acid or mixtures thereof as a thickener or stabiliser, wherein the concentrate allows purification of wastewater using membrane filtration units without blocking them or causing other damage to the membrane.

2. The liquid detergent concentrate of claim 1, wherein the alkalinity source is selected from the group consisting of sodium hydroxide, potassium hydroxide, and mixtures thereof.

3. The liquid detergent concentrate of claim 1, wherein the crosslinker for the crosslinked polyacrylic acid or polymethacrylic acid is a polyalkenyl polyether compound.

4. The liquid detergent concentrate of claim 1, wherein the nonionic surfactant is an alkoxylated alcohol of the formula $R—(OC_2H_4)x-(OC_3H_6)_y$, wherein R is a C6-C22 alkyl or alkenyl group, x is 0 to 18 and y is 0 to 10 and the sum of x and y is at least 5 and one of x or y may be 0.

5. The liquid detergent concentrate of claim 1, wherein the composition does not contain a cationic surfactant.

6. The liquid detergent concentrate of claim 1, wherein the amount of alkyl polyglycoside in the detergent is less than 1 wt-%.

7. The liquid detergent concentrate of claim 1, wherein the amount of fatty acid soap in the detergent is less than 1 wt-%.

8. The liquid detergent concentrate of claim 1, wherein the amount of EDTA in the detergent is less than 10 wt-%.

9. The liquid detergent concentrate of claim 1, wherein the detergent concentrate has a viscosity range of from 500 to 10.000 mPas at 20° C. measured at 20 revolutions per minute on a Brookfield RVT viscosimeter with spindle 2.

10. The liquid detergent concentrate of claim 1, wherein the droplet size of the emulsion is less than 25 μm.

11. The liquid detergent concentrate of claim 10, wherein the droplet size of the emulsion is less than 10 μm.

12. The liquid detergent concentrate of claim 1, wherein the detergent does not contain any bleaching agent.

13. The liquid detergent concentrate of claim 1, wherein the detergent contains 5 to 40 wt-% water.

14. The liquid detergent concentrate of claim 13, wherein the detergent contains 10 to 25 wt-% water.

15. The liquid detergent concentrate of claim 1, wherein the detergent additionally comprises additives selected from the group consisting of builder, pH modifier, antimicrobial agents, abrasives, anti-redeposition agents, sequestrants, softener, conditioner, viscosity modifying agents, wetting modifying agents, enzymes, optical brighteners, and mixtures thereof.

16. A stable aqueous use solution comprising, from 0.5 to 25 wt. % of the liquid detergent concentrate of claim 1, and water.

17. A method for washing textiles comprising providing the liquid detergent of claim 1, diluting the liquid detergent to a stable aqueous use solution to a concentration of 0.5 to 25 wt-% based on the total use solution, washing the textiles in an institutional or a household washing machine in the use solution.

18. The method of claim 17, further comprising collecting the use solution from the washing machine; and purifying the use solution using a membrane filter.

* * * * *

UNITED STATES PATENT AND TRADEMARK OFFICE

CERTIFICATE OF CORRECTION

PATENT NO. : 8,278,259 B2
APPLICATION NO. : 12/281885
DATED : October 2, 2012
INVENTOR(S) : Shamayeli et al.

It is certified that error appears in the above-identified patent and that said Letters Patent is hereby corrected as shown below:

IN THE CLAIMS:

Col. 12, line 14, claim 9: "10.000 mPas" should read --10,000 mPas--

Signed and Sealed this
Ninth Day of April, 2013

Teresa Stanek Rea

Teresa Stanek Rea
*Acting Director of the United States Patent and Trademark Office*